US009843128B2

(12) United States Patent
Tsai et al.

(10) Patent No.: US 9,843,128 B2
(45) Date of Patent: Dec. 12, 2017

(54) WATERPROOF ELECTRICAL CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Long-Fei Chen, New Taipei (TW); Dong Xiang, New Taipei (TW); Chung-Fu Liao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/368,215

(22) Filed: Dec. 2, 2016

(65) Prior Publication Data

US 2017/0162975 A1 Jun. 8, 2017

(30) Foreign Application Priority Data

Dec. 3, 2015 (CN) ..... 2015 2 0990637 U

(51) Int. Cl.

| | |
|---|---|
| ***H01R 13/648*** | (2006.01) |
| ***H01R 13/52*** | (2006.01) |
| ***H01R 13/6585*** | (2011.01) |
| ***H01R 24/60*** | (2011.01) |
| *H01R 107/00* | (2006.01) |
| *H01R 12/72* | (2011.01) |
| *H01R 13/6594* | (2011.01) |

(52) U.S. Cl.

CPC ..... *H01R 13/5202* (2013.01); *H01R 13/6585* (2013.01); *H01R 24/60* (2013.01); *H01R 12/724* (2013.01); *H01R 13/6594* (2013.01); *H01R 2107/00* (2013.01)

(58) Field of Classification Search

CPC ..... H01R 23/688; H01R 13/5219; H01R 23/6873; H01R 13/65802; H01R 23/7073

USPC ..... 439/101, 108, 271, 272, 607.08, 607.11, 439/607.35, 607.36, 607.37, 607.4, 660

See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,011,956 | B1 * | 9/2011 | Yang | H01R 13/5202 439/589 |
| 8,348,688 | B2 * | 1/2013 | Liu | H01R 13/5219 439/271 |
| 8,827,742 | B2 * | 9/2014 | Wang | H01R 24/68 439/569 |
| 9,112,296 | B2 * | 8/2015 | Zhang | H01R 13/516 |
| 9,306,336 | B2 * | 4/2016 | Chang | H01R 13/6471 |
| 9,385,484 | B2 * | 7/2016 | Chen | H01R 13/6582 |

(Continued)

FOREIGN PATENT DOCUMENTS

| | | |
|---|---|---|
| TW | M496259 | 2/2015 |

*Primary Examiner* — Thanh Tam Le

(74) *Attorney, Agent, or Firm* — Bookoff McAndrews, PLLC

(57) ABSTRACT

An electrical connector is provided, which includes: a first housing having a discontinuous portion, an insulating main body received in the first housing, a shielding piece disposed in the insulating main body, two conductive terminal sets disposed on the insulating main body, a capping body covering the discontinuous portion, and a sealing body coupled with the first housing. By the design of the capping body, water vapor or moisture cannot seep through the discontinuous portion to enter the first housing.

8 Claims, 7 Drawing Sheets

(56) References Cited

U.S. PATENT DOCUMENTS

| | | | | |
|---|---|---|---|---|
| 9,429,360 | B2 * | 8/2016 | Hsiao | F26B 3/28 |
| 9,444,177 | B2 * | 9/2016 | Tsai | H01R 13/5202 |
| 9,553,410 | B2 * | 1/2017 | Zhao | H01R 13/6581 |
| 2016/0020560 | A1 * | 1/2016 | Ju | H01R 24/78 439/607.05 |
| 2016/0093974 | A1 | 3/2016 | Lai | |
| 2016/0104957 | A1 * | 4/2016 | Kim | H01R 13/6581 439/78 |
| 2016/0141805 | A1 * | 5/2016 | Zhao | H01R 13/504 439/607.01 |

* cited by examiner

WATERPROOF ELECTRICAL CONNECTOR

CROSS-REFERENCE TO RELATED APPLICATION(S)

This application claims priority to Chinese Patent Application No. 201520990637.X, filed on Dec. 3, 2015, the entirety of which is incorporated by reference herein.

BACKGROUND OF THE INVENTION

1. Field of the Invention

The present disclosure relates to connectors, and more particularly, to electrical connectors.

2. Description of Related Art

With the rapid development of electronics industry, modern electronic products nowadays must include practical and diverse designs. Electrical connectors are connecting devices configured to electrically connect to cables, circuit boards, and other electronic components, and are widely applicable to a variety of electronic products, such as computers, laptop computers, mobile phones, etc.

Conventional the electrical connectors usually have slits or holes disposed on their inner case, however, the design cannot prevent the moisture or water from seeping through the case and further into the electrical connectors, thus ultimately affecting the electrical function. Accordingly, waterproof casings have been designed and provided in the market that can be attached to external electrical connectors for waterproofing, such as the disclosure in Taiwan Patent No. M496259.

However, the electrical connector covered with a waterproof casing occupies a greater space since the waterproof casing is bulky and designed to cover the electrical connector. Therefore, it undesirably increases the size of the electrical connector and cannot satisfy the market demand for miniaturization which may have an impact on the internal layout space for electrical connecters.

As such, how to avoid the problems mentioned above has become an urgent issue that needs to be addressed.

SUMMARY OF THE INVENTION

In view of the above-described drawbacks, the present disclosure provides an electrical connector, which includes: a first shell having a receiving space, a port and an opening opposite to each other and communicating the receiving space, and at least a discontinuous portion formed on the surface of the first shell and communicating the receiving space; an insulated housing received in the receiving space of the first shell; a shielding piece disposed in the insulated housing; two conductive terminal sets each having a plurality of conductive terminals arranged in a row and parallelly positioned at two opposite sides of the shielding piece, wherein each of the plurality of conductive terminals has a contacting portion exposed from the port, and a soldering portion protruding from the opening; at least a capping body attached to the first shell for covering the discontinuous portion thereof; and a sealing body coupled with the first shell and disposed around the port of the first shell.

In the above electrical connector, the discontinuous portion may be a cavity, a slit or a combination thereof. For example, the first shell is formed by bending a metallic sheet to allow dovetail grooves on the two ends of the metallic sheet to be coupled together, and the slit is formed at the engaged portions of the dovetail grooves. Or, the first shell has a protruding portion formed from its surface and protruding toward the receiving space to engage the insulated housing, and the cavity is defined by the protruding portion and the insulated housing.

In the above electrical connector, the insulated housing includes a base portion and a tongue portion extending from the base portion, where the base portion is located in the opening, and the tongue portion is disposed within the first shell and located in the port.

In the above electrical connector, the capping body is a plastic sheet or a plastic film.

In the above electrical connector, a second shell is disposed on and in contact with the surface of the first shell. For example, the second shell totally or partially covers the surface the first shell. The first shell further has a placement portion sticking out of the second shell and configured to combine with the sealing body.

In the above electrical connector, the sealing body leans against an external device configured to be combined with the electrical connector.

Based on the above, by the design of the capping body covering the discontinuous portion, the electrical connector of the present disclosure is capable of preventing water vapor or moisture from entering the first shell and seeping through the discontinuous portion, thereby protecting electrical functions of the conductive terminals from being damaged by the water vapor or moisture.

In addition, as the capping body is located inside the second shell, there is no need to install any waterproof structure on the external of the second shell, thereby avoiding the increase in size of the electrical connector, such that the electrical connector is not only water proof, but also remains slim, thin and light-weighted.

BRIEF DESCRIPTION OF DRAWINGS

FIG. 2A' is a partially exploded view of the electrical connector of FIG. 2A;

FIG. 2B' is a partially exploded view showing from under of the electrical connector of FIG. 2A';

DETAILED DESCRIPTION OF PREFERRED EMBODIMENTS

The following illustrative embodiments are provided to illustrate the present disclosure, these and other advantages and effects can be apparent to those skilled in the art after reading this specification.

It should be noted that structures, scales, sizes, etc., shown in all the drawings in reference with the specification, are not intended to limit the present disclosure, but merely facilitate the understanding and reading for those skilled in the art.

Modifications and variations in different scale or sizes can be made without departing from the spirit of the present disclosure. Further, the terms such as "upper", "lower", "front", "back", "left", "right", "first", "second", "on", "a" etc. are merely for illustrative purposes and should not be construed to limit the scope of the present disclosure, and any amendment or adjustment of relative relations without substantively changing the technical content is rendered to be in the scope of the present disclosure.

Figure 1A:
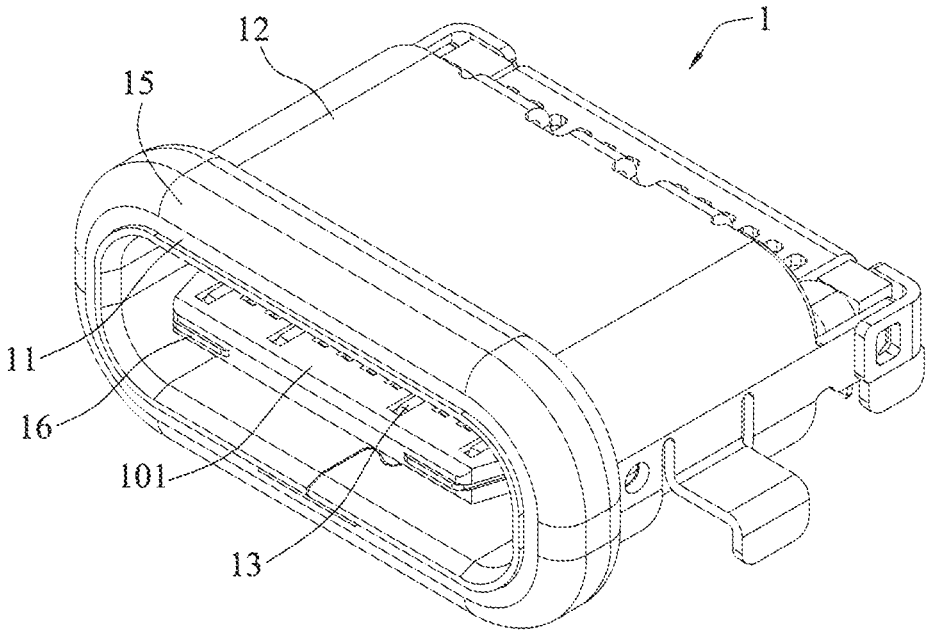
FIG. 1A is a schematic view of the electrical connector according to the present disclosure.
Figure 2A:
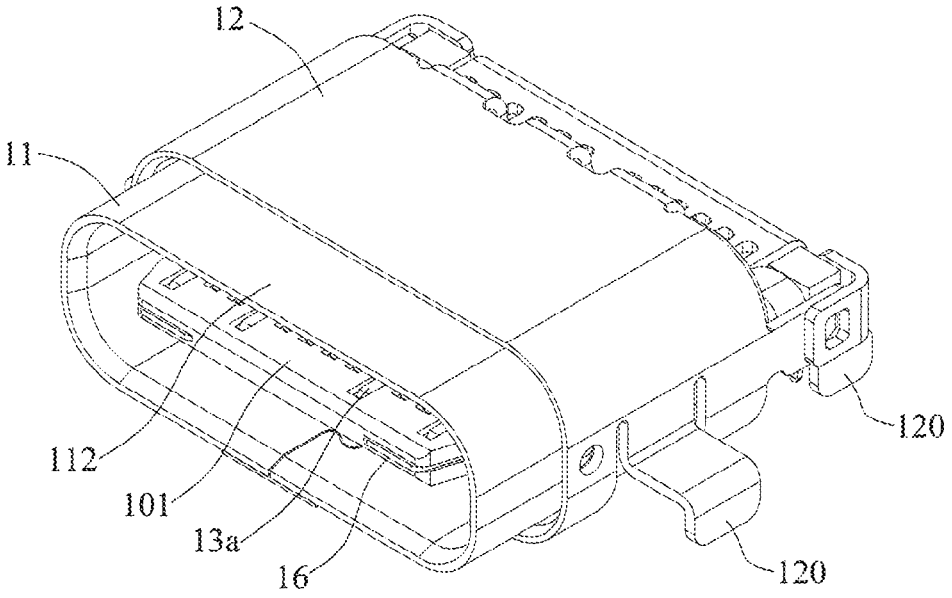
FIG. 2A is a schematic view of the electrical connector of FIG. 1A without a sealing body.
Figure 2B:
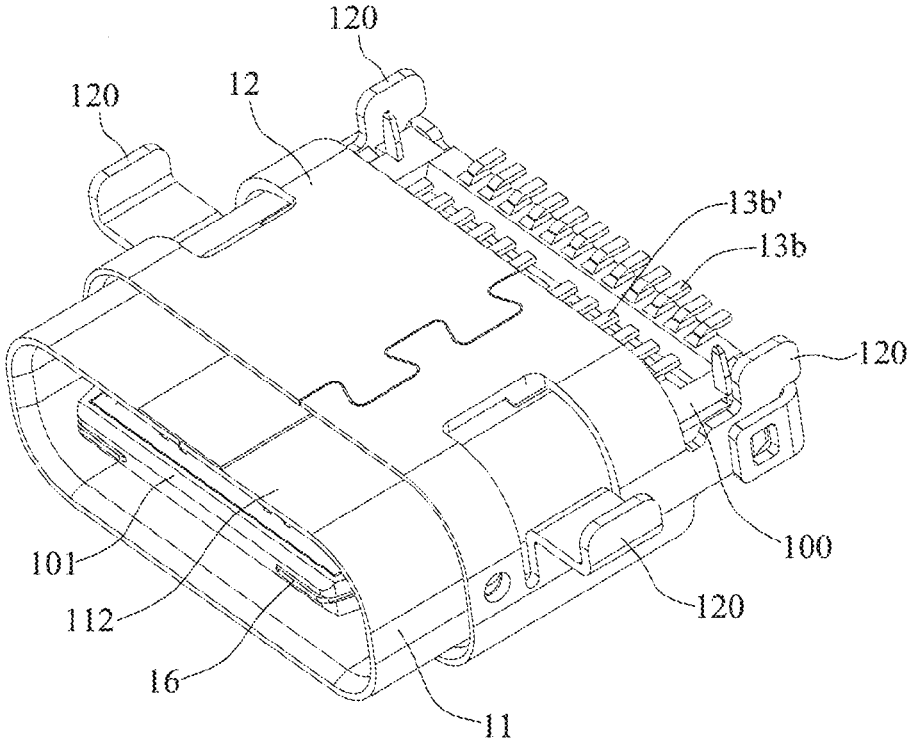
FIG. 2B is a schematic view showing from under of the electrical connector of FIG. 2A.
Figure 2A:
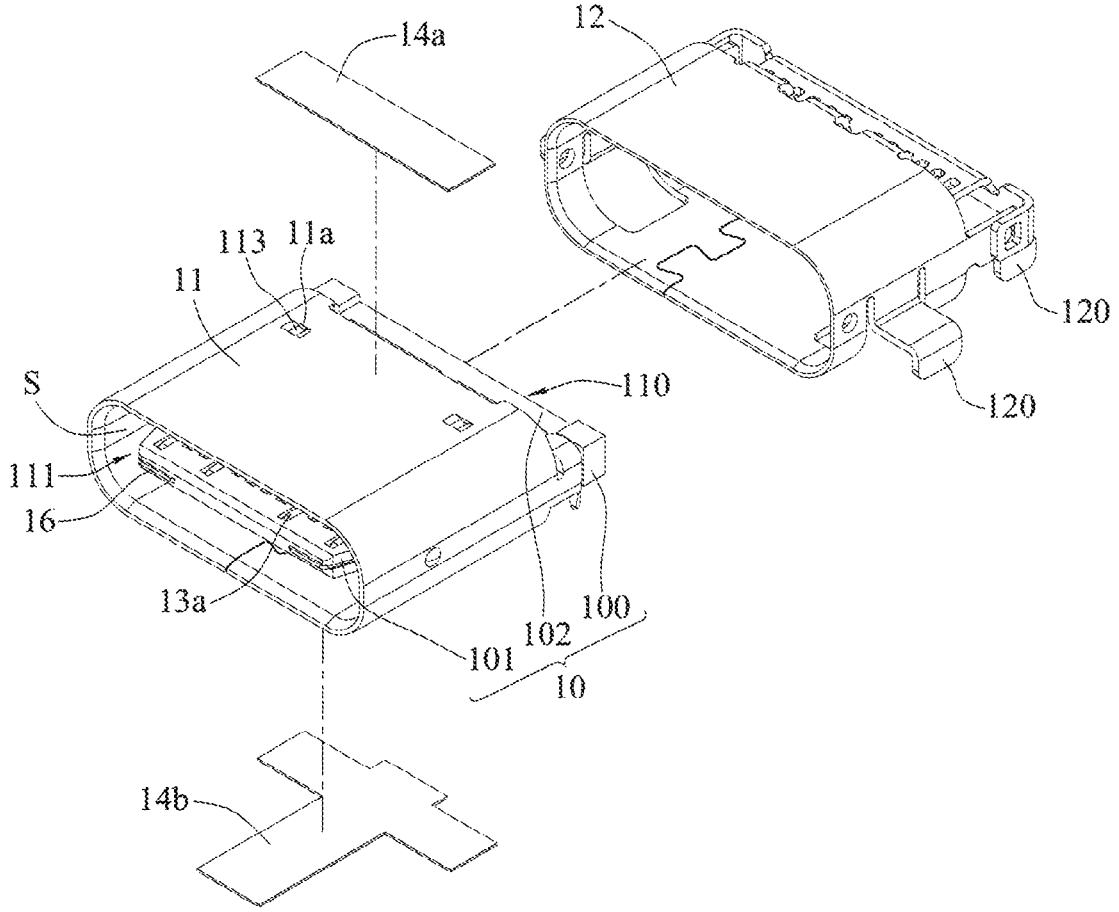
Figure 2B:
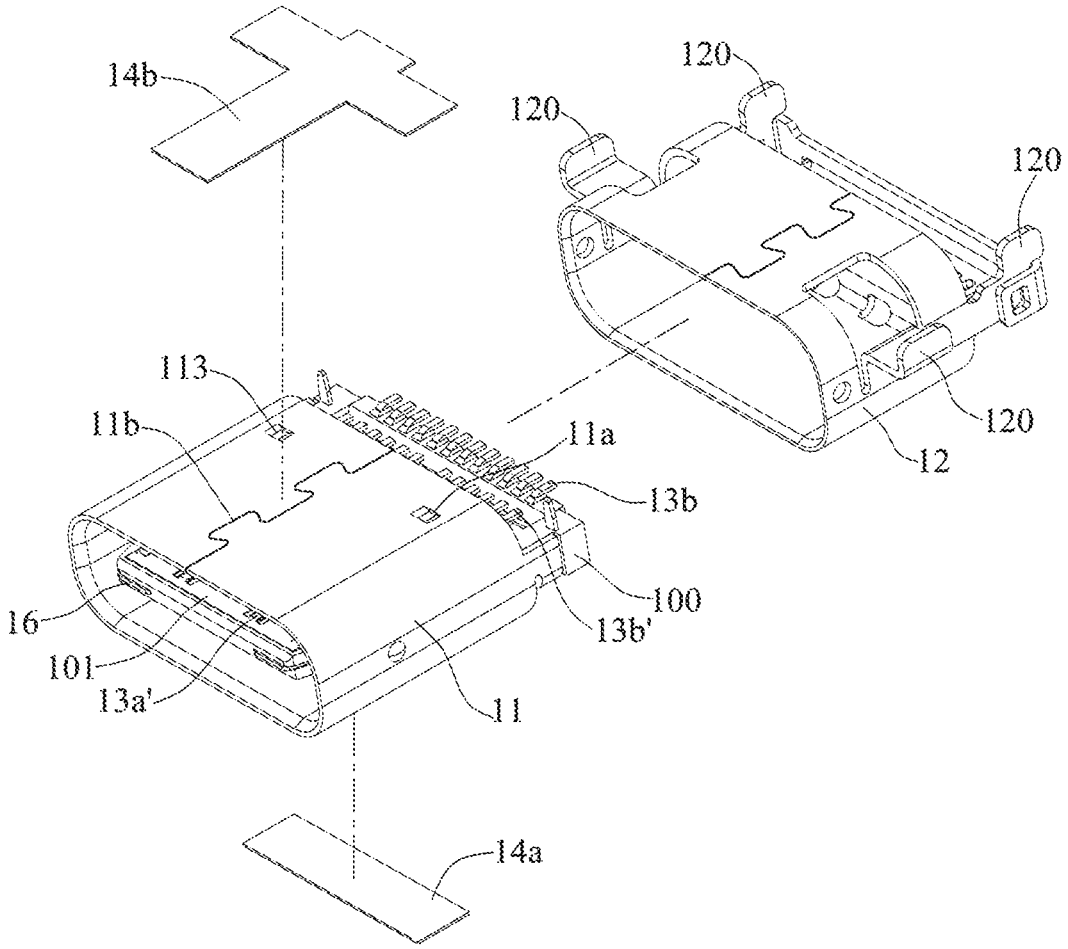

FIGS. 1A, 2A, 2A', 3A, 4A and 4B are schematic views of the electrical connectors according to the present disclosure; FIGS. 2B, 2B' and 3B are schematic views showing from under of the electrical connectors according to the present disclosure.

An electrical connector 1 includes an insulated housing 10, a first shell 11, a second shell 12, a shielding piece 16, two rows of conductive terminal sets 13, 13', a plurality of capping bodies 14*a*, 14*b* and a sealing body 15.

In an embodiment, the electrical connector 1 is, for example, a Universal Serial Bus (USB), in particular a USB Type-C configuration.

The insulated housing 10 includes a base portion 100, a tongue portion 101 and a board portion 102, where the blade tongue portion 101 extends from the base portion 100, and the base portion 100 and the board portion 102 protrude out the rear side of the first shell 11.

Figure 4A:
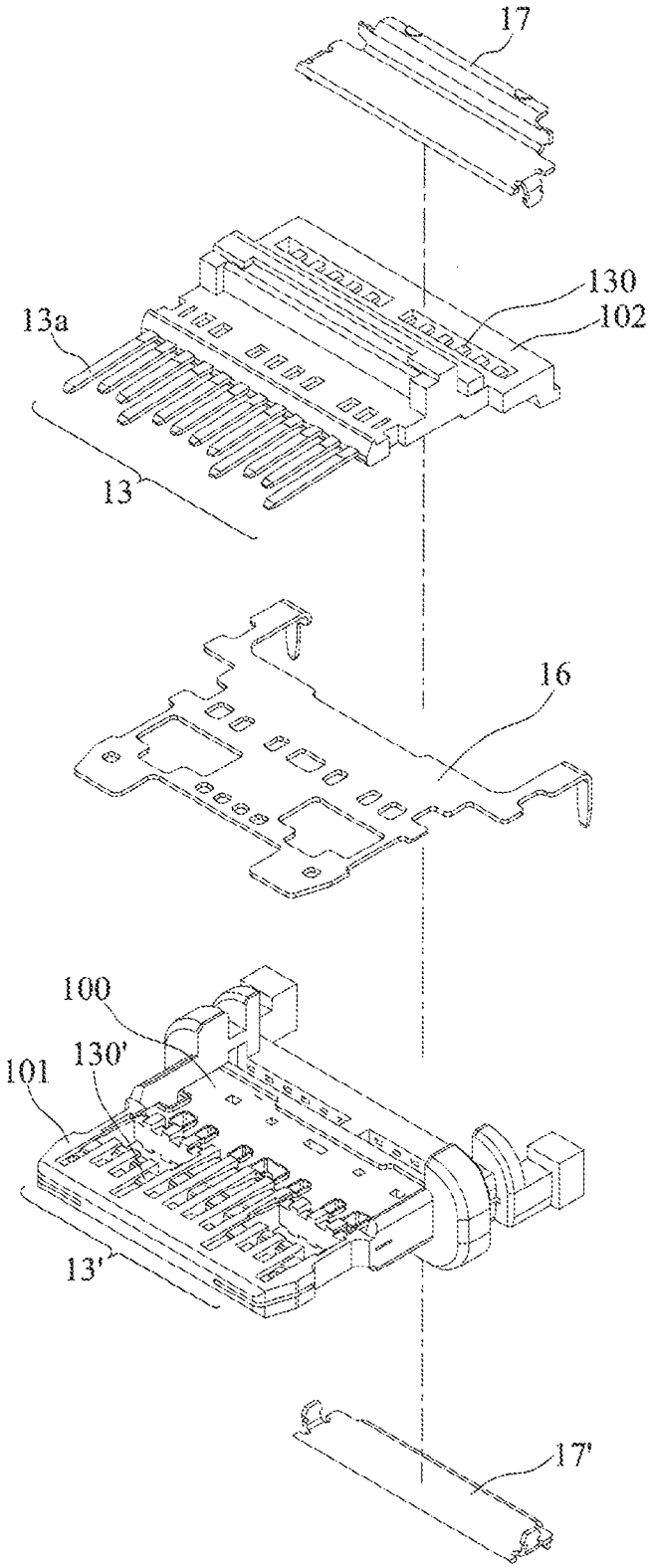
FIG. 4A is a schematic view of the electrical connector of FIG. 3A without a first shell and a capping body.
Figure 4B:
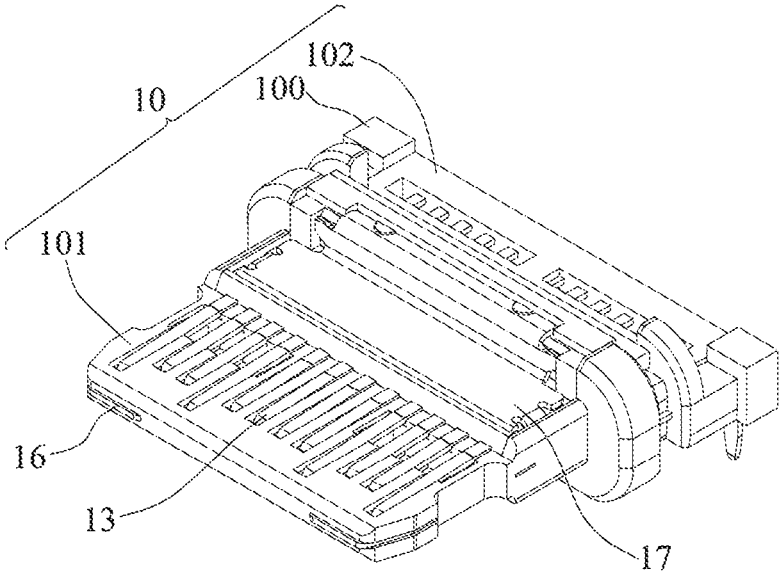
FIG. 4B is an exploded view of the electrical connector of FIG. 4A.

As shown in FIGS. 4A and 4B, the shielding piece 16 is disposed inside the insulated housing 10.

The conductive terminal sets 13 and 13' include a plurality of conductive terminals 130 and 130' (as shown in FIG. 4A), respectively. The conductive terminal sets 13 and 13' are firmly disposed on the upper and lower sides of the insulated housing 10, and the conductive terminals 130 and 130' have contacting portions 13*a* and 13*a'* disposed on the tongue portion 101, respectively, and further have soldering portions 13*b* and 13*b'* protruding from the rear side of the first shell, where the soldering portions 13*b* and 13*b'* are configured to electrically connect to electronic devices (not shown).

In the embodiment, the conductive terminals 130 and 130' extend from the tongue portion 101 toward the base portion 100, and bend and further extend downwardly to present like bending beams.

Moreover, the conductive terminals 130 and 130' include ground terminals (Gnd), power source terminals (Power/VBUS) and reserve terminals (RFU), and further include differential signal terminal pairs when needed.

Furthermore, the upper conductive terminal set 13 is formed on the board portion 102, where the contacting portions 13*a* are located on the tongue portion 101 (shown in FIG. 4A), the lower conductive terminal set 13' extends on the base portion 100 and the tongue portion 101 and has ground pieces 17 and 17' disposed on the base portion 100 and the board portion 102, respectively.

In addition, the conductive terminal sets 13 and 13' are arranged as rows and disposed on the upper and lower sides of the shielding piece 16, i.e., the shielding piece 16 is disposed between the upper conductive terminal set 13 and the lower conductive terminal set 13'.

In view of the conventional designs of USB conductive terminals that are well known to persons skilled in the art, further descriptions thereof are not to be elaborated for concise and brevity.

The first shell 11 is a metallic housing, such as an iron shell to be used as the inner case and have a receiving space S for receiving the insulated housing 10 and the conductive terminal sets 13 and 13'.

In the embodiment, the first shell 11 further includes at least a discontinuous portion 11*a*, 11*b* formed on the surface of the first shell 11 and communicating the receiving space S.

In the embodiment, when forming the first shell 11, a metallic sheet is designed to have dovetail grooves on its two ends, then the metallic sheet is bended to allow the dovetail grooves to be coupled together, forming an annular shell having a slit (as the discontinuous portion 11*b* shown in FIG. 2B') located at engaged portions of the dovetail grooves. Protruding portions 113 (shown in FIGS. 2A' and 2B' where two protruding portions 113 on the upper surface of the first shell 11, and four protruding portions 113 on the lower surface of the first shell 11) are formed on the upper and lower surfaces of the first shell 11 by pressing or stamping the same, and protrude toward the receiving space S, i.e., the protruding portions 113 are also located in the receiving space S, such that the protruding portions 113 engage the insulated housing 10. Cavities such as the discontinuous portions 11*a* shown in FIGS. 2A' and 2B' are formed on the front and rear sides of the protruding portions 113.

Accordingly, moisture or water vapor seeps through the slits or cavities that are defined as the discontinuous portions 11*a* and 11*b* on the first shell 11. It should be noted that the variety of the discontinuous portions are not limited to the above configurations.

The first shell 11 further has a port 111 formed on the front side of the receiving space S and an opening 110 formed on the rear side of the receiving space S, where the base portion 100 is located in the opening 110, the tongue portion 101 is disposed on the first shell 11 and located in the port 111, such that the tongue portion 101 and the contacting portions 13*a* and 13*a'* are exposed from the port 111, and the base portion 100, the board portion 102, and the soldering portions 13*b* and 13*b'* protrude from the opening 110.

The second shell 12 is a metallic casing, such as an iron shell to be used as an external case disposed on and in contact with the surface of the first shell 11, so as to cover the first shell 11 and conceal the rear upper side of the base portion 100, such that the first shell 11 protrudes from the front side of the second shell 12 to form a placement portion 112, as shown in FIG. 2A, i.e., the first shell 11 has the placement portion 112 sticking out of the second shell 12.

In the embodiment, as shown in FIG. 2B, the base portion 100 and the soldering portions 13*b* and 13*b'* are exposed from the rear lower side of the second shell 12.

In addition, the second shell 12 further has a plurality of pins 120 on the left side and right side of the second shell 12, and the pins 120 are close to the front side and rear side of the second shell 12, allowing the electrical connector 1 to be assembled to an electronic device (not shown).

And, the second shell 12 partially covers the surface of the first shell 11. Nevertheless, it should be understood that the second shell 12 can also totally cover the surface of the first shell 11.

Figure 3A:
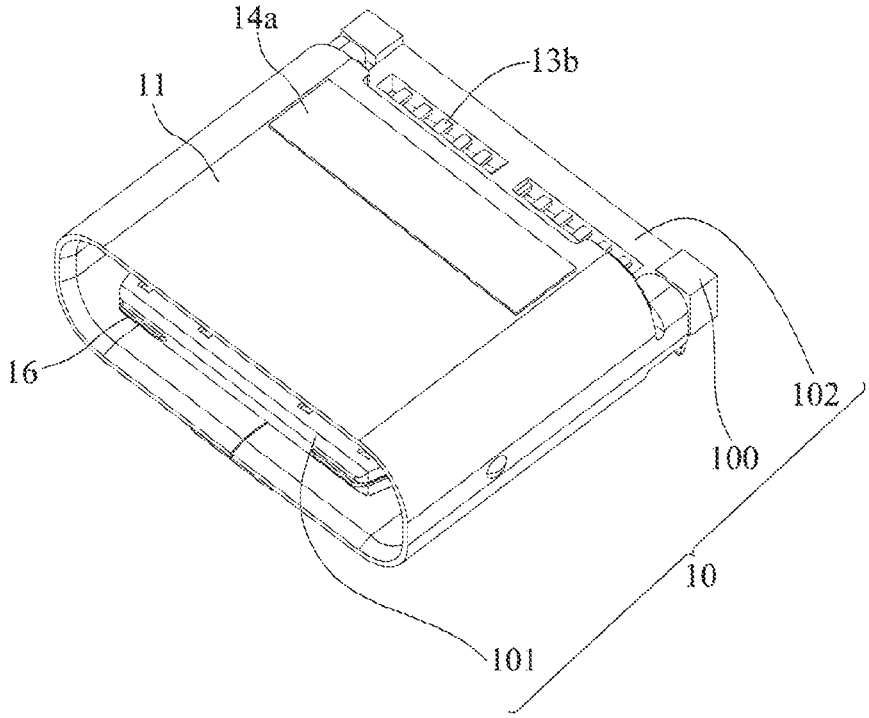
FIG. 3A is a schematic view of the electrical connector of FIG. 2A without a second shell.
Figure 3B:
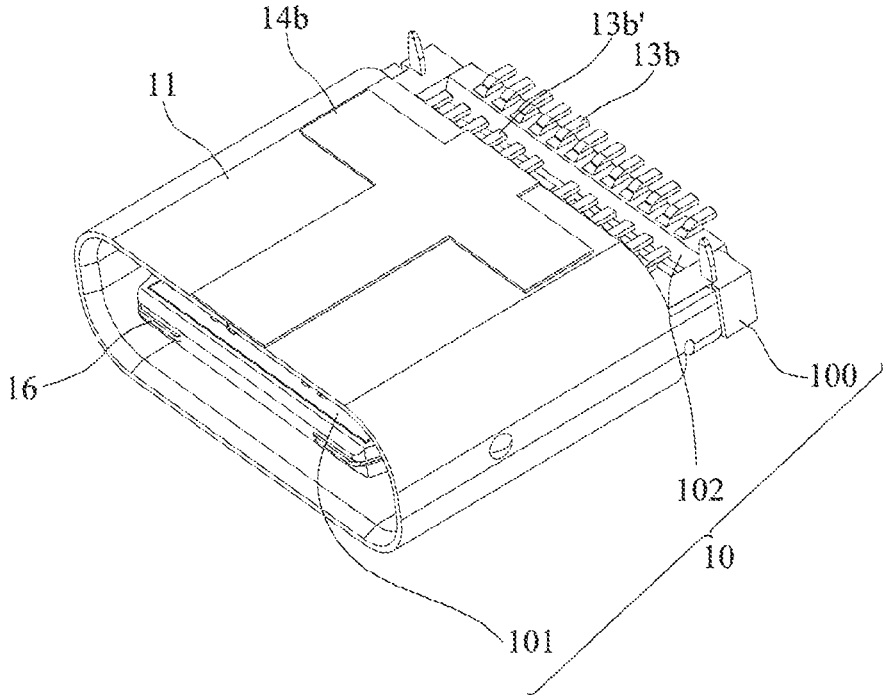
FIG. 3B is a schematic view showing from under of the electrical connector of FIG. 3A.

The capping bodies 14*a* and 14*b* are disposed on and in contact with the upper and lower sides of the first shell 11 for covering entirely the discontinuous portions 11*a* and 11*b* (shown in FIGS. 3A and 3B), and the capping bodies 14*a* and 14*b* are received in the second shell 12, such that the second shell 12 covers the capping bodies 14*a* and 14*b* (shown in FIGS. 2A and 2B).

In the embodiment, the capping bodies 14*a* and 14*b* are sheets or films formed in the shape corresponding to the distribution layout of the discontinuous portions 11*a* and 11*b*, such as shaped as a bar, a cross or the like.

In particular, the capping bodies 14*a* and 14*b* are formed by a plastic material, such as mylar products produced by E. I. du Pont de Nemours and Company.

The sealing body 15 is combined with the placement portion 112 of the first shell 11, and is exposed from the second shell 12.

In the embodiment, the sealing body 12 is an annular-shaped insulating pad or an elastic ring (so called O-ring), or the like.

Figure 1B:
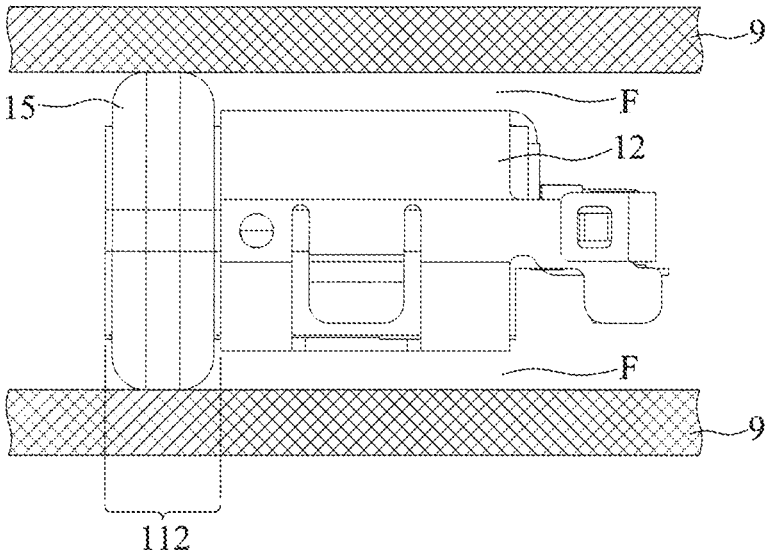
FIG. 1B is a schematic side view of the electrical connector of FIG. 1A when in use.

Also, as shown in FIG. 1B, the height of the sealing body 15 relative to the first shell 11 is greater than the height of the second shell 12 relative to the first shell 11.

Therefore, by covering the capping bodies 14*a* and 14*b* over the discontinuous portions 11*a* and 11*b*, the electrical connector 1 of the embodiment is capable of preventing water vapor or moisture from entering the first shell 11 and seeping through the discontinuous portions 11*a* and 11*b*, thereby protecting electrical functions of the conductive terminals 13 and 13' from water vapor or moisture.

Moreover, since the capping bodies 14*a* and 14*b* are located inside the second shell 12, there is no need to install any waterproof structure on the external of the second shell 12, avoiding the increase in size of the electrical connector 1, such that the electrical connector 1 remains thin and light-weighted.

Further, when the electrical connector 1 is combined with an external device 9 to form a product (not shown), the sealing body 15 leans against the external device 9, which prevents moisture from passing through the flowing space F between the external device 9 and the second shell 12, thereby preventing moisture from entering the product through the flowing space F and effectively achieving waterproofing of the device. Therefore, the electrical connector 1 of the present disclosure is equipped with the waterproofing feature by merely forming the sealing body 15 on the first shell 11, which avoids the conventional bulky waterproof casing that covers the second shell 12. Although the outer profile around the port 111 of the electronic connect 1 is slightly enlarged, the internal layout space of the product is not affected, thereby satisfying the market demand for slim, thin and light-weighted products.

In conclusion, by the use of the capping bodies over the discontinuous portions of the first shell, the electrical connector of the present disclosure not only prevents water vapor or moisture from seeping through the discontinuous portions of the first shell, but also the electrical connector is slim, thin and light-weighted.

The above-described descriptions of the detailed embodiments are only to illustrate the preferred implementation according to the present disclosure, and it is not to limit the scope of the present disclosure. Accordingly, all modifications and variations completed by those with ordinary skill in the art should fall within the scope of present disclosure defined by the appended claims.

What is claimed is:

1. An electrical connector, comprising:

a first shell having a receiving space, a port and an opening opposite to each other and communicating with the receiving space, and at least a discontinuous portion formed on a surface of the first shell and communicating with the receiving space;

a second shell disposed on the surface of the first shell and in contact with the first shell;

an insulated housing received in the receiving space of the first shell, wherein the insulated housing comprises a base portion and a tongue portion protruding from the base portion;

a shielding piece disposed in the insulated housing;

an upper conductive terminal set comprising a plurality of conductive terminals arranged in a row, wherein each of the conductive terminals of the upper conductive terminal set has a contacting portion disposed on an upper surface of the tongue portion and a soldering portion protruding from the opening;

a lower conductive terminal set comprising a plurality of conductive terminals arranged in a row, wherein each of the conductive terminals of the lower conductive terminal set has a contacting portion disposed on a lower surface of the tongue portion and a soldering portion protruding from the opening;

at least a capping body attached to the first shell for covering the discontinuous portion thereof; and a sealing body coupled with the first shell and disposed around the port of the first shell, wherein the surface of the first shell has a placement portion protruding out of the second shell and configured to combine with the sealing body, and wherein a height of the sealing body relative to the first shell is greater than a height of the second shell relative to the first shell, and a flowing space is formed between an external device and the second shell while the sealing body leans against the external device.

2. The electrical connector of claim 1, wherein the discontinuous portion is a cavity, a slit, or a combination thereof.

3. The electrical connector of claim 2, wherein the first shell is formed by bending a metallic sheet to allow dovetail grooves on two ends of the metallic sheet to be coupled together, and the slit is formed at engaged portions of the dovetail grooves.

4. The electrical connector of claim 2, wherein the first shell further has a protruding portion formed from the surface of the first shell and protruding toward the receiving space, the protruding portion is configured to engage the insulated housing, and the cavity is defined by the protruding portion and the insulated housing.

5. The electrical connector of claim 1, wherein the base portion is located at the opening, and the tongue portion is disposed in the first shell and located at the port.

6. The electrical connector of claim 1, wherein the capping body is a plastic sheet or a plastic film.

7. The electrical connector of claim 1, wherein the second shell covers partially the surface of the first shell.

8. The electrical connector of claim 1, wherein the sealing body leans against the external device, and the external device is configured to be combined with the electrical connector.

* * * * *